US011208293B2

(12) United States Patent
Katz et al.

(10) Patent No.: US 11,208,293 B2
(45) Date of Patent: Dec. 28, 2021

(54) BOBBIN AND SPOOL MANAGEMENT SYSTEM

(71) Applicant: DPG USA Inc., Schaumburg, IL (US)

(72) Inventors: Sabrina Katz, Chicago, IL (US); Daniel Schaumann, Chicago, IL (US); Ronald C. Farnum, Lombard, IL (US); Nikhil Gupta, Schaumburg, IL (US)

(73) Assignee: DPG USA INC., Schaumburg, IL (US)

( * ) Notice: Subject to any disclaimer, the term of this patent is extended or adjusted under 35 U.S.C. 154(b) by 306 days.

(21) Appl. No.: 16/302,230

(22) PCT Filed: May 9, 2017

(86) PCT No.: PCT/US2017/031646
§ 371 (c)(1),
(2) Date: Nov. 16, 2018

(87) PCT Pub. No.: WO2017/200793
PCT Pub. Date: Nov. 23, 2017

(65) Prior Publication Data

US 2019/0168988 A1 Jun. 6, 2019

Related U.S. Application Data

(60) Provisional application No. 62/337,560, filed on May 17, 2016.

(51) Int. Cl.
*B65H 49/36* (2006.01)
*B65H 49/38* (2006.01)
*D05B 91/16* (2006.01)

(52) U.S. Cl.
CPC ..... *B65H 49/36* (2013.01); *B65H 49/38* (2013.01); *D05B 91/16* (2013.01)

(58) Field of Classification Search
CPC ..... B65H 49/36; B65H 49/38; D05B 91/16
USPC ..... 206/390, 391, 392, 393, 394, 507, 506, 206/574, 389; 211/85.5
See application file for complete search history.

(56) References Cited

U.S. PATENT DOCUMENTS 1,367,685 A * 2/1921 Cohn ..... D05B 91/14 242/139
2,063,319 A * 12/1936 Lee ..... B65D 71/70 206/392
2,699,866 A * 1/1955 Russell, Jr. ..... B65D 71/70 206/392
2,876,898 A * 3/1959 Schmidt ..... B65D 71/70 206/392
2,914,271 A 11/1959 Staufert
3,227,394 A 1/1966 Parks
(Continued)

*Primary Examiner* — J. Gregory Pickett
*Assistant Examiner* — Jenine Pagan
(74) *Attorney, Agent, or Firm* — Robert S. Alexander; Ferrells, PLLC; Anna L. Kinney

(57) ABSTRACT

A bobbin and spool management system includes a bobbin topper having a central disc with upwardly and downwardly extending stanchions projecting therefrom, each being capped with a mushroom bolster and having a medially located chamfered collar. The upwardly projecting stanchion is adapted to mate with an axial bore in the barrel of a bobbin and retain the bobbin while the downwardly projecting stanchion is adapted to penetrate the axial bore in the barrel of a supply spool and be retained on the supply spool.

4 Claims, 7 Drawing Sheets

(56) References Cited

U.S. PATENT DOCUMENTS

| | | | | | |
|---|---|---|---|---|---|
| 3,392,827 | A * | 7/1968 | Bogren | B65D 71/70 | 206/392 |
| 3,730,340 | A * | 5/1973 | Neubert | B65H 49/06 | 206/392 |
| 3,765,539 | A * | 10/1973 | Boyle | B65D 71/70 | 211/59.1 |
| 5,960,954 | A * | 10/1999 | Seybold | B65D 71/70 | 206/389 |
| 6,367,645 | B1 * | 4/2002 | Trygg | B65D 21/0231 | 220/513 |
| 6,513,742 | B2 * | 2/2003 | Watson | B65H 49/322 | 112/302 |
| 6,899,225 | B2 * | 5/2005 | Shuert | B65D 71/70 | 108/55.1 |
| 8,869,720 | B2 * | 10/2014 | Ingram, III | B65H 57/16 | 112/80.01 |
| 2005/0173586 | A1 | 8/2005 | Murphy, Jr. | | |
| 2016/0184858 | A1 | 6/2016 | Gupta et al. | | |

* cited by examiner

BOBBIN AND SPOOL MANAGEMENT SYSTEM

CLAIM FOR PRIORITY

This Non-Provisional patent application is based on U.S. Provisional Patent Application Ser. No. 62/337,560, filed on May 17, 2016, entitled "Bobbin Management System". The priority of Application Ser. No. 62/337,560 is claimed and the disclosure of said application is incorporated herein by reference.

DESCRIPTION OF PREFERRED EMBODIMENTS

Sewing machines extend far beyond simple utilitarian devices for stitching pieces of fabric together. They are now capable of quilting as well as making automated buttonholes, embroidery designs, piping and a wide variety of decorative stitches. Often they are further encumbered with a wide variety of needles, attachments, needle plates and presser feet including buttonhole feet, rolled hem feet, blind hem feet, ruffling feet, zipper feet, gauges, rulers, tapes, seam guides, clips, tracing wheels and thread treatments. Little wonder then, that the days are long past when seamstresses could fit everything into a sewing basket to be taken everywhere and used when a free moment is presented.

Particularly when used for decorative designs such as embroidery, the user of the sewing machine often will employ many different styles, weights, types and colors of threads to express their artistic vision. Many applications, the user will employ matched threads in both the bobbin and the supply spool. Commonly prior to use of particular thread, the user will wind a judiciously chosen amount of thread off of the supply spool onto a bobbin. Typically the amount wound on to the bobbin is sufficient to ensure that the user will not run out of thread on the bobbin while in the middle of sewing a particular stitch. Accordingly, users prefer to wind too much thread on the bobbin rather than too little and, Inasmuch as it is impractical to rewind thread off of the bobbin, considerable thread will remain on the bobbin after the contemplated stitching is accomplished. Thus, bobbins are often sold in quantities of 10 to 50 per package as users will typically have possibly dozens of bobbins with thread on them at any one time. For embroiderers, pre-wound bobbins are sold in packages of 144. Similarly bobbin storage cases holding upwards of 25 bobbins are sold to help maintain order. While in some applications, the bobbin thread does not have to match stitch thread, in other cases, users will prefer to employ bobbin thread of identical color and weight to the supply thread.

This invention will help maintain a one-to-one association between thread on supply spools and thread on bobbins while helping to manage what could otherwise become a surfeit of bobbins interfering with the creative process by supplying a bobbin topper having a central disc with upwardly and downwardly extending stanchions projecting therefrom, each being capped with a mushroom bolster and having a medially located chamfered collar. The upwardly projecting stanchion is adapted to mate with an axial bore in the barrel of a bobbin and retain the bobbin while the downwardly projecting stanchion is adapted to penetrate the axial bore in the barrel of supply spool and be retained on the supply spool. Preferably, the central disc has an upwardly projecting bulwark skirt about its outer periphery with a thread retention slot formed therein while the upwardly projecting stanchion has a medially located chamfered collar thereabout and is capped with a mushroom bolster. Additionally, the system may also include a supply spool retention fixture comprising a plurality of upwardly rising cruciform spool retention columns each surmounting a disk shaped planar region bordered by an upwardly rising sidewall, each said cruciform spool retention column being adapted to penetrate the axial cavity of a thread supply spool and frictionally retain said spool by an interference fit engaging the interior sidewall of the throughbore of the spool.

The bobbin/spool management system of the present invention is conveniently sized to accommodate the bobbins and supply spools encountered by consumers in connection with sewing machines sold for consumer use which typically, but not universally, accept one of three styles of bobbins:

1. L-Style having a height of 0.359" (0.912 cm), a diameter of 0.837" (2.126 cm) and a bore of approximately 0.236" (0.6 cm);
2. Class 15(A-Style) bobbins having a height of 0.465" (1.181 cm); a diameter of 0.815" (2.070 cm) and a through bore of about 0.236" (0.6 cm); and
3. M-style bobbins used on larger consumer and smaller commercial machines having a height of 0.435" (1.105 cm), a diameter of 1.023" (2.598 cm) and a throughbore of about 0.236" (0.6 cm).

A more thorough, but far from exhaustive, account of various styles and sizes available is set forth in Table 1 below. Supply spools encountered in retail/consumer trade are usually between about 1.9 cm to about 4.1 cm in diameter, whilst the throughbore of the spool ranges between about 6.9 mm to about 7.75 mm. Accordingly, the clear radius of the planar region around the cruciform spool retention column is about 2 cm from the axis of the cruciform spool retention column. The cruciform spool retention column has cross beams with a length of at least about 6.4 mm enabling them to penetrate and be retained in bores ranging from 6.9 mm to 8 mm.

Preferably, the diameter of the stanchions on the bobbin topper will be from about 4 mm up to about 7 mm whilst both the collar and the mushroom cap on the bobbin-side stanchion will have a diameter of from about 7 mm up to about 13 mm with the length of the collar ranging from about 1.5 mm to about 10 mm while the portion of the mushroom cap having a diameter greater than about 2 mm will have a length of from about 1 mm to about 5 mm. Preferably, the lower surface of the mushroom will be displaced from about 8 mm to about 13 mm above the central disc to allow the cap of the mushroom to penetrate the bore of the bobbin. The central disc, including peripheral rim, is preferably between about 20 mm-45 mm, more preferably between about 19 mm-45 mm, still more preferably 20 mm-40 mm, most preferably between about 20 mm and 38 mm, and even more preferably between 20-35; and most preferably about 20-26 mm. The thickness of the peripheral rim is preferably between about 1-3 mm, more preferably 1.5 to 25 mm, as is the thickness of the central disc and the height of the peripheral rim.

Preferably, the bobbin topper of the present invention is comprised of an elastomer having a durometer between about 30 and 75 on the Shore "A" scale, more preferably between about 35 and 70, still more preferably between about 40 and 70, even more preferably between about 45 and 70 and most preferably between about 55 and 65. While any convenient durable elastomer having the requisite durometer may be used, preferably a thermoplastic elastomer is used for convenience in manufacture. Suitable elastomer can be formed from: styrenic block copolymers (often referred to as TPE-s); thermoplastic olefins (TPE-o); thermoplastic polyurethanes (TPU); thermoplastic polyamides; thermoplastic copolyesters; and elastomeric alloys. Suitable thermoplastic elastomeric compounds are available from Exxon/Mobil as Santoprene™; Termoton® and Termoton®-V from Termopol Polimer, Arnitel® from DSM, Solprene® from Dynasol; Engage™ from Dow Chemical, Hytrel® from Du Pont, Dryflex® and Mediprene® from ELASTO, Kraton™ from Kraton Polymers, Pibiflex®; Sofprene®; Laprene® and Forprene® from the SO.F.TER.Group.

In many cases, the ability to keep the bobbin together with the supply spool supplying the thread wrapped therearound will still leave a very large collection of spools and bobbins to be organized. To facilitate order, this invention optionally provides a multi-cavity spool holder having, on its upper face, a multiplicity of lower end receptacles adapted to receive the lower end of a cylindrical supply spool ranging from about 19 mm up to about 42 mm in diameter each lower end receptacle having an upright post positioned therein adapted to enter a central throughbore in a supply spool having a diameter of from about 6.9 mm up to about 7.8 mm while the lower face has a plurality of upper end receptacles adapted to receive the upper end of cylindrical supply spool having a bobbin mounted thereupon using the bobbin topper described above. To that end, the lower face of the spool organizer has a plurality of dual level receptacles formed therein, the upper most level comprising a plurality of bobbin receptacles each being adapted to receive bobbins having an outside diameter of up to 26 mm and a height of from 8.6 up to about 12 mm with the upper wall of each bobbin receptacle comprising the uppermost portion of a lower end receptacle. Accordingly, a shoulder is formed in each receptacle approximately 12 mm beneath the upper surface of the bobbin receiving portion forming a retention portion adapted to receive a supply spool having a diameter preferably up to the largest diameter accommodated by the upper end receptacles on the upper face of the spool organizer.

The spool holder may advantageously be formed from any convenient polymer. In some cases, the spool organizer will be formed from a thermoplastic elastomer, while in other cases, it will be formed from a more rigid polymer. Since color is so important in threads for sewing, it is highly advantageous that the spool organizer be translucent or transparent so that the color of the thread on each spool can be readily determined. In many cases, a transparent polystyrene will be preferred both for its excellent transparency and its relatively low cost. In some cases, peripheral elastomeric bolsters will be located near the lower end of the upper end receptacles to aid in retention of spools inserted therein. Similarly, peripheral bolsters may be added to the upper end of the lower end receptacles to help retain spools placed therein and the lower end of the bobbin receptacles as well. Known double-shot injection molding processes can be employed to place these bolsters as desired.

BRIEF DESCRIPTION OF THE DRAWINGS

The invention is described in detail below with reference to the appended drawings, wherein like numerals designate similar parts. In the Figures.

DESCRIPTION OF A PREFERRED EMBODIMENT

Figure 1:
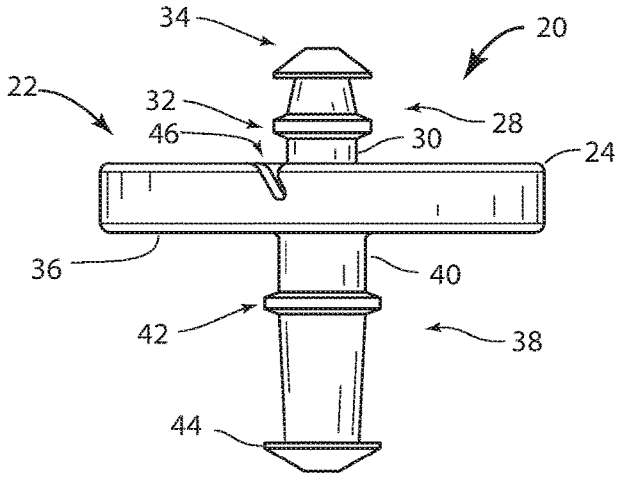
FIG. 1 is a front elevation of a bobbin topper of the present invention.
Figure 2:
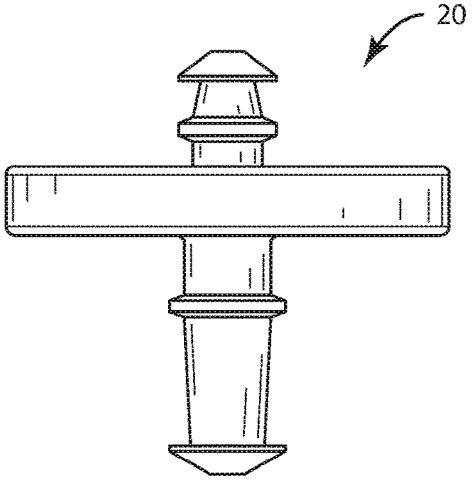
FIG. 2 is a rear elevation of the bobbin topper of FIG. 1.
Figure 3:
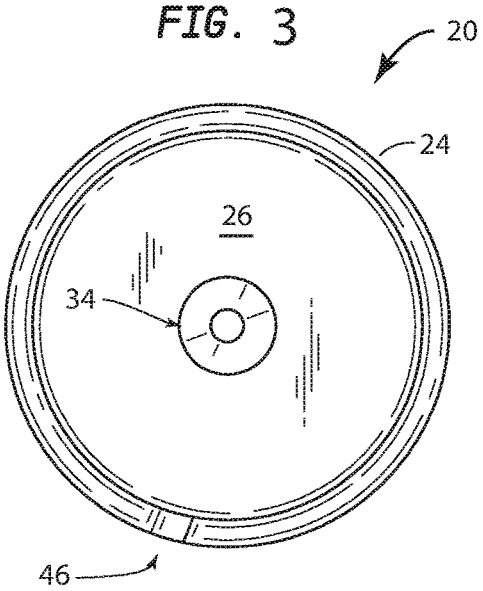
FIG. 3 is a top plan view of the bobbin topper of FIG. 1.
Figure 4:
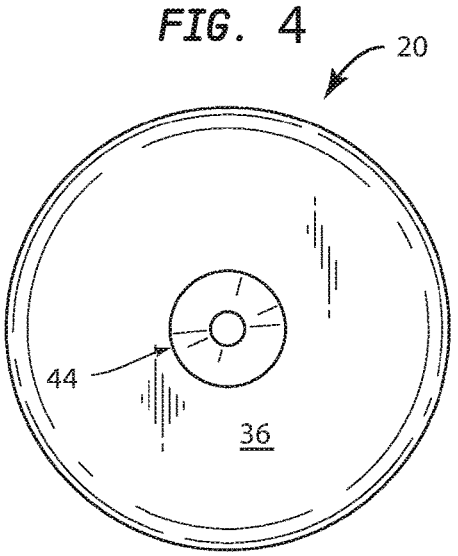
FIG. 4 is a bottom plan view of the bobbin topper of FIG. 1.
Figure 5:
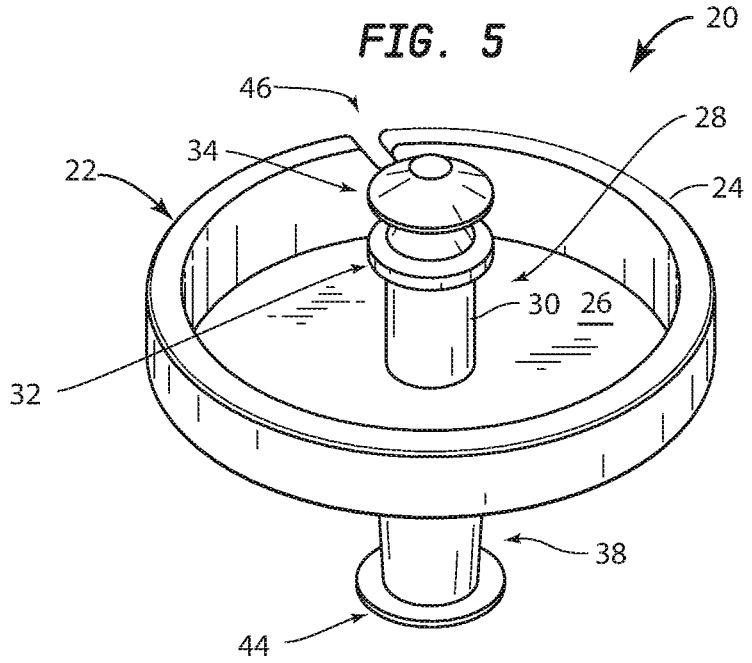
FIG. 5 is an isometric perspective of the bobbin topper of FIG. 1 taken from an upper position.
Figure 6:
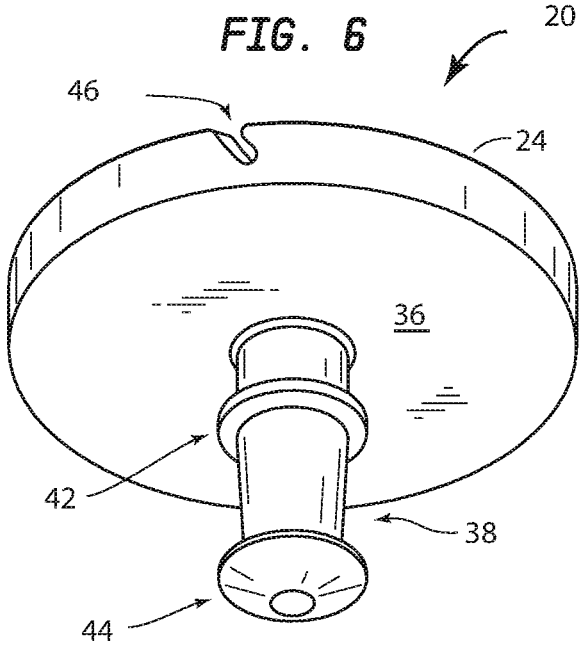
FIG. 6 is an isometric perspective of the bobbin topper of FIG. 1 taken from a lower position.
Figure 7:
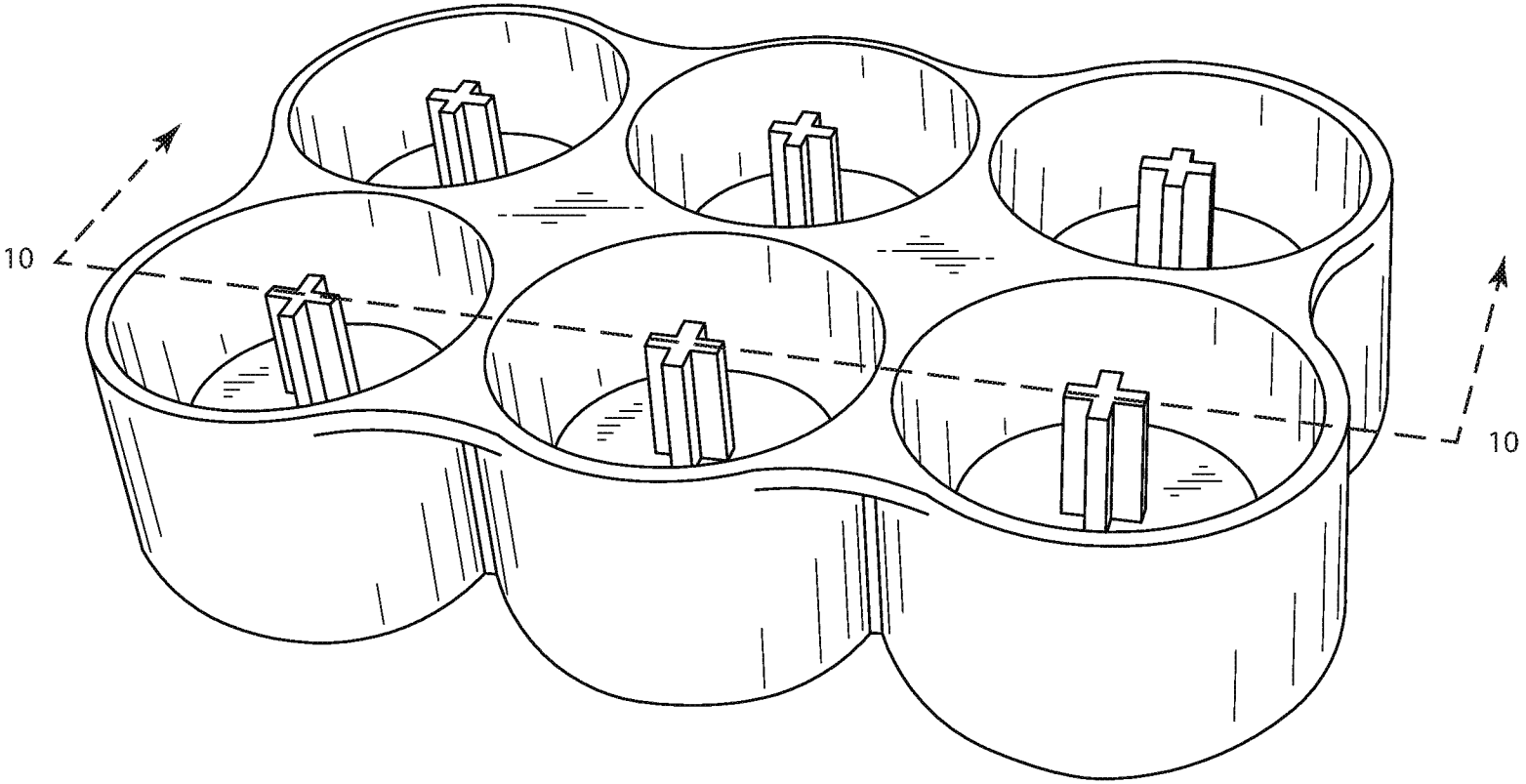
FIG. 7 is an isometric perspective of a spool organizer of the present invention taken from an upper position

The invention is described in detail below with reference to several embodiments and numerous examples. Such discussion is for purposes of illustration only. Modifications to particular examples within the spirit and scope of the present invention, set forth in the appended claims, will be readily apparent to one of skill in the art. Terminology used herein is given its ordinary meaning consistent with the exemplary definitions set forth immediately below.

With respect to the various ranges set forth herein, any upper limit recited may, of course, be combined with any lower limit for selected sub-ranges.

In FIGS. 1-6, bobbin topper 20 comprises central disc 22 having upwardly extending peripheral rim 24 disposed thereabout encompassing upper surface 26 of central disc 22. Bobbin shaft 30 of bobbin stanchion projects upwardly from central disc 22 and has bobbin collar 32 medially disposed thereabout and being surmounted by mushroom cap 34. Spool stanchion 38 projects downwardly from central disc 22 and has medially disposed spool collar 42 thereabout terminating in frustoconical foot 44. Bobbin topper 20 is preferably comprised of an elastomeric material such that bobbin stanchion 28 will enter into and be frictionally retained with a cylindrical bore having a diameter of between about 5.5 and 6.4 mm which encompasses many, if not almost all, bobbins presently on the consumer market in the United States. Table 1 sets forth approximate dimensions on many of the bobbins sold in the United States as measured. It appears that the exact dimensions of bobbins are considered to be confidential by manufacturers as they are not easily ascertained by internet search.

TABLE 1

Approximate Measured Dimensions of a Variety of Retail Bobbins

| | ID | | OD | | Height | |
|---|---|---|---|---|---|---|
| | units | | | | | |
| class | (mm) | (in) | (mm) | (in) | (mm) | (in) |
| Class 15 | 6.04 | 0.237795 | 21 | 0.826772 | 11.7 | 0.46063 |
| Class 66 | 6.3 | 0.248031 | 19.6 | 0.771654 | 10.7 | 0.42126 |
| Class 15J | 6.21 | 0.244488 | 20.6 | 0.811024 | 11.13 | 0.438189 |
| Class M | 6.06 | 0.238583 | 25.5 | 1.003937 | 10.93 | 0.430315 |
| Style L | 6.3 | 0.248031 | 20.8 | 0.818898 | 8.9 | 0.350394 |
| Bernina | 6.06 | 0.238583 | 20.5 | 0.807087 | 11.77 | 0.463386 |
| Brother SA155 | 6 | 0.23622 | 21 | 0.826772 | 9.2 | 0.362205 |
| Brother SA156 | 6.4 | 0.251969 | 20.5 | 0.807087 | 11.55 | 0.454724 |
| Brother SA159 | 6 | 0.23622 | 21 | 0.826772 | 9.03 | 0.355512 |
| Juki | 6 | 0.23622 | 21 | 0.826772 | 8.97 | 0.35315 |
| Pfaff | 5.88 | 0.231496 | 22.08 | 0.869291 | 8.6 | 0.338583 |
| unbranded | 5.91 | 0.232677 | 22 | 0.866142 | 7.55 | 0.297244 |
| " | 5.55 | 0.218504 | 21.68 | 0.853543 | 10.36 | 0.407874 |
| " | 6.06 | 0.238583 | 20.4 | 0.80315 | 11.54 | 0.454331 |
| " | 5.86 | 0.230709 | 21.8 | 0.858268 | 8.77 | 0.345276 |
| " | 5.98 | 0.235433 | 21.06 | 0.829134 | 9.09 | 0.357874 |
| " | 6.02 | 0.237008 | 21.5 | 0.846457 | 9.13 | 0.359449 |
| range | 5.55-6.4 | | 19.6-25.5 | | 8.6-12 | |

In addition, Singer makes at least three varieties of "Touch & Sew" bobbins without bores that are, accordingly, not suited for use with the bobbin topper of the present invention. It should be noted that apparently manufacturers are reluctant to publish details concerning the exact dimensions of bobbins, so all dimensions present herein are more or less inexact having been determined using a digital micrometer, and thus, even though dimensions are presented to the hundredth of a millimeter, it is entirely questionable whether the reported measurements are truly accurate to a hundredth of a millimeter.

Figure 11:
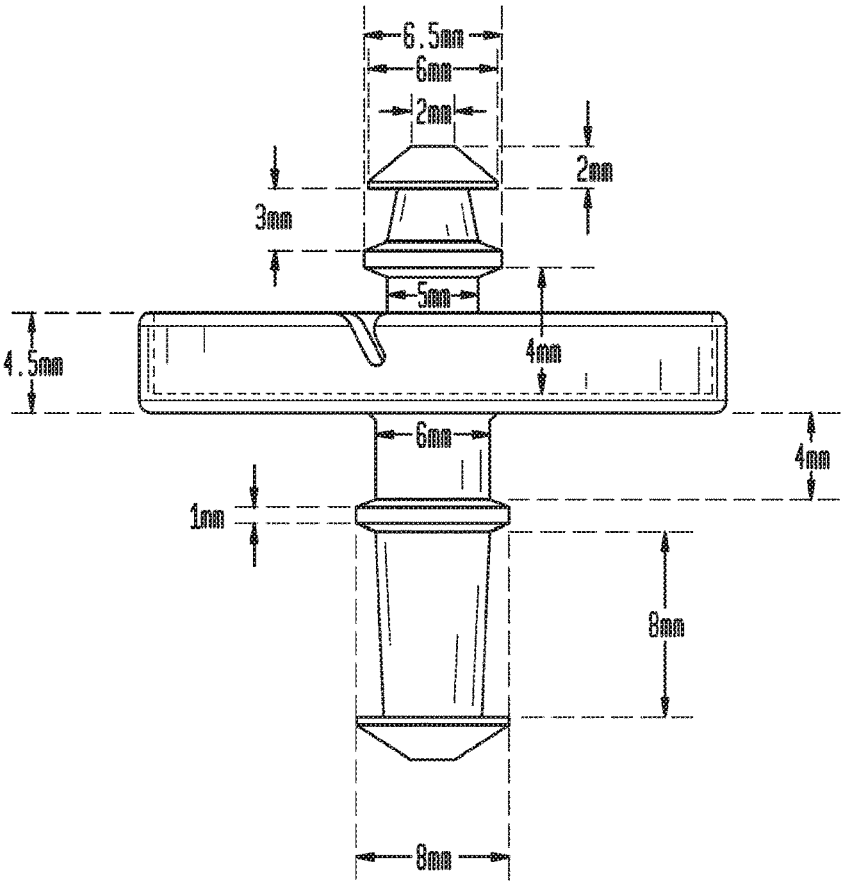
FIG. 11 is a dimensioned copy of FIG. 1 showing preferred dimensions for one particular embodiment of a bobbin topper of the present invention.
Figure 12:
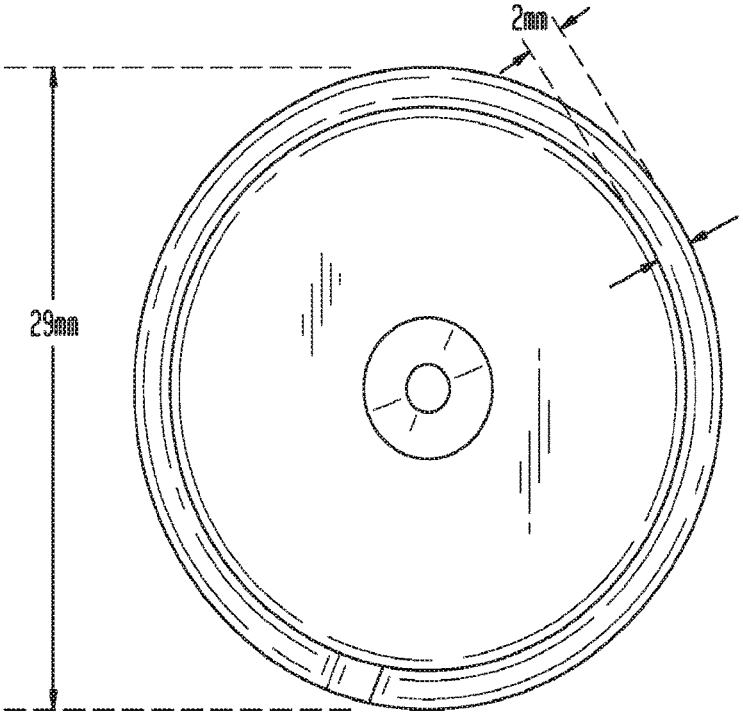
FIG. 12 is a dimensioned copy of FIG. 3 showing preferred dimensions for one particular embodiment of a spool organizer of the present invention.
Figure 13:
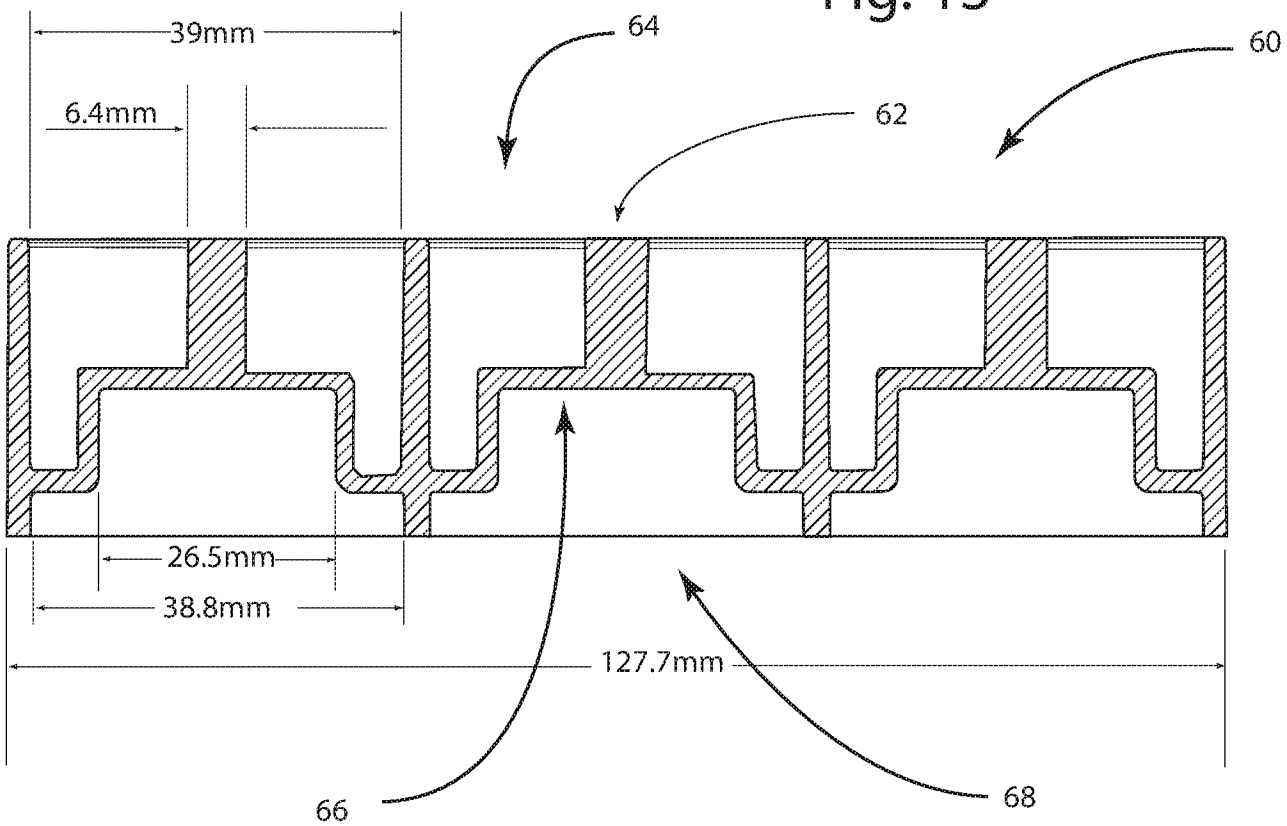
FIG. 13 is a dimensioned copy of FIG. 10 showing preferred dimensions for one particular embodiment of a spool organizer of the present invention.

Desirably, the diameter of bobbin stanchion 30 on bobbin topper 20 will be from about 4 mm up to about 5.5 mm while bobbin collar 32 on the bobbin-stanchion 30 will have a diameter of from about 6.5 mm up to about 8 mm with the length of bobbin collar 32 ranging from about 1.5 mm to about 5 mm while mushroom cap 34 will have a diameter of from about 6 mm up to about 8 mm whilst the portion of mushroom cap 34 having a diameter greater than about 2 mm will have a length of from 1 mm up to about 5 mm. It is highly desirable that bobbin collar 32 have a diameter of about 6.45 mm up to about 6.65 mm whilst mushroom cap 34 has a diameter of between about 5.65 mm and about 6.35 mm. Surprisingly, it has been found that stanchions with these dimension when fabricated from an elastomer as described herein will readily accommodate and retain bobbins having a through bore of between about 5.55 mm and 6.4 mm. Preferably, lower surface 31 of mushroom cap 34 will be displaced from about 8 mm to about 12 mm above upper surface 26 of central disc 22 to allow mushroom cap 34 to penetrate securely into the bore of the bobbin. The diameter of central disc 22, excluding peripheral rim 24, is preferably between about 19 mm-27 mm, more preferably between about 19.2 mm-26 mm, and most preferably about 19.7-25.5 mm. The thickness of peripheral rim 24 is preferably between about 1-3 mm, more preferably 1.5 to 2.5 mm, most preferably about 2 mm as is the thickness of central disc 22 and the height of peripheral rim 24. Preferably, the diameter of spool stanchion 38 will be between about 5 mm and 6.85 mm, most preferably between about 5.5 and 6.8 mm and most preferably between about 5.75 and 6.7 mm, whilst the length of spool stanchion 38 will be between about 10 and 35 mm, more preferably between about 10 and 25 mm and most preferably from about 12 to about 15 mm. The diameter of frustoconical foot 44 and spool collar 42 will be between about 7.8 and 8.5 mm, most preferably between 7.9 and 8.3 mm. In some instances spool collar 42 will be about 0.5 mm greater in diameter than frustoconical foot 44. Most importantly, the particular dimensions are chosen so that bobbin stanchion 28 as well as bobbin collar 32 and mushroom cap 34 will easily enter and be frictionally retained within the throughbore of the various styles of bobbins with which it is intended to be used but can be readily removed therefrom as desired by the user while spool stanchion 38, frustoconical foot 44 and spool collar 42 will easily enter the central throughbore in the desired spools of thread. The dimensions illustrated in FIGS. 11 and 12 have been found to meet these criteria well for the bobbins described in Table 1 above as well as for the spools described in Table 2 below. Preferred dimensions and angles not explicitly called out on FIGS. 11 and 12 may be determined from the drawing by scaling from explicitly referenced dimensions and the angles displayed. Whilst it is easiest to manufacture the mold for bobbin topper 20 as a body of rotation, it is not strictly necessary to do so. If it is desired that various features such as bobbin collar 32, mushroom cap 34, spool collar 42, frustoconical foot 44 or any other feature described as a body of rotation vary from strict circularity, suitable performance can be obtained so long as the maximum width of the feature conforms to the guidelines given herein for diameter. It should also be noted that whilst thread retention slit 46 is depicted with considerable width in FIGS. 1 and 11 for ease in visualization, the width of thread retention slit 46 should be less than the diameter of a typical sewing thread and in most cases, the walls of thread retention slit 46 will normally bear against each other unless an object is interposed.

Approximate measured dimensions of a variety of spools of thread sold at retail in the United States are set forth in Table 2.

TABLE 2

Approximate Measured Dimensions of a Variety of Retail Spools

| | Spool ID | | OD | | Height | |
|---|---|---|---|---|---|---|
| | (mm) | (in) | (mm) | (in) | (mm) | (in) |
| American Quilting | 7.7 | 0.30315 | 38.6 | 1.519685 | 44.34 | 1.745669 |
| Coats & Clark | 7.47 | 0.294094 | 30 | 1.181102 | 53.11 | 2.090945 |
| Coats & Clark | 7.3 | 0.287402 | 30.11 | 1.185433 | 36 | 1.417323 |
| Coats & Clark | 7.55 | 0.297244 | 30 | 1.181102 | 36.14 | 1.422835 |
| Coats & Clark | 7.43 | 0.29252 | 30.2 | 1.188976 | 43.8 | 1.724409 |
| Coats & Clark | 7.2 | 0.283465 | 30.16 | 1.187402 | 36 | 1.417323 |
| Gutterman | 7.2 | 0.283465 | 19.3 | 0.759843 | 55.8 | 2.19685 |
| Gutterman | 6.9 | 0.271654 | 41.23 | 1.623228 | 55 | 2.165354 |
| metrosene | 7.09 | 0.279134 | 26.5 | 1.043307 | 57.5 | 2.26378 |
| Sulky | 7.3 | 0.287402 | 20 | 0.787402 | 55 | 2.165354 |
| Sulky | 7.75 | 0.305118 | 33.65 | 1.324803 | 45 | 1.771654 |
| range | 6.9-7.75 | | 19.3-41.23 | | 36-57.5 | |

Figure 8:
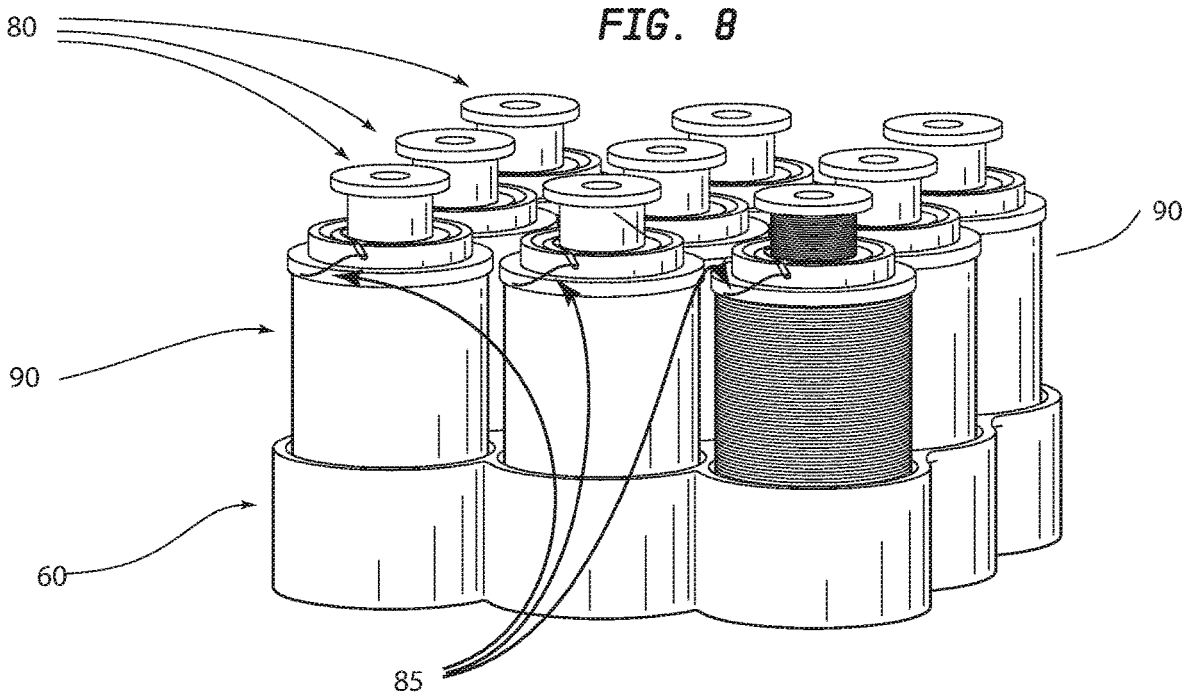
FIG. 8 is an isometric perspective of a spool organizer of FIG. 7 taken from an upper position with the spool organizer being loaded with supply spools having bobbin toppers retained thereupon by bobbin toppers as illustrated in FIGS. 1-6.
Figure 9:
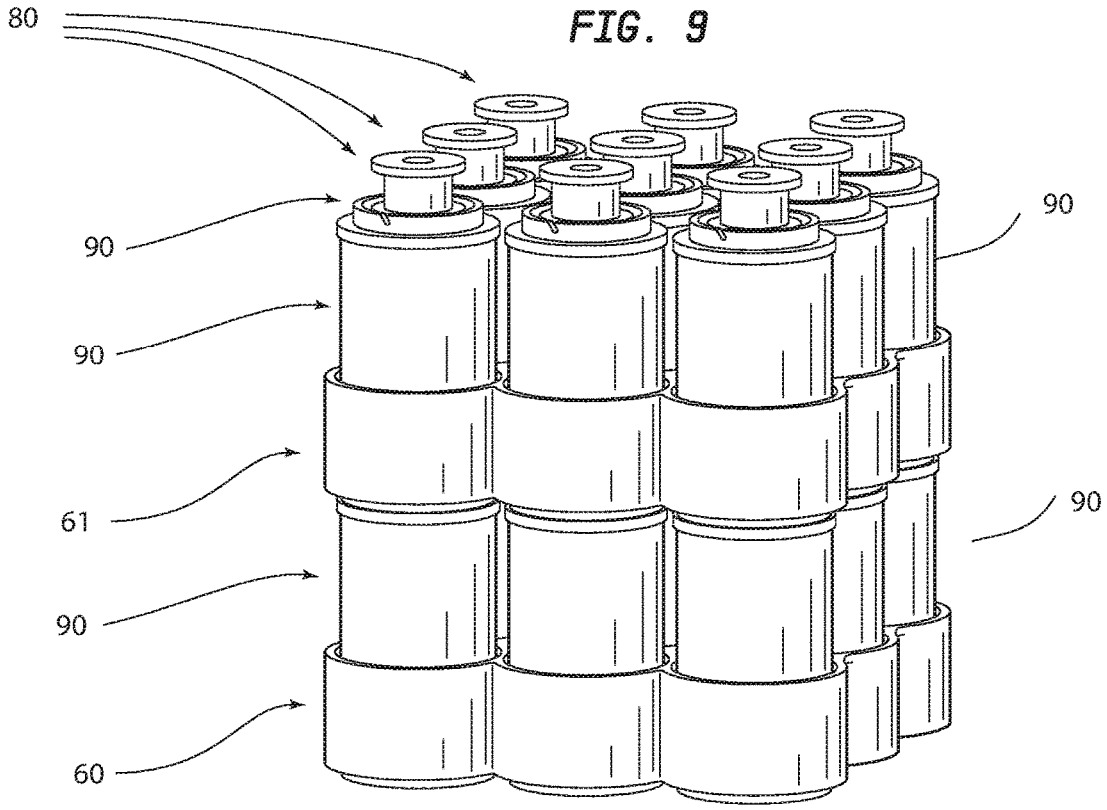
FIG. 9 is an isometric perspective of a stack of two spool organizers of FIG. 7 taken from an upper position with the spool organizer being loaded with supply spools having bobbin toppers retained thereupon by bobbin toppers as illustrated in FIGS. 1-6.
Figure 10:
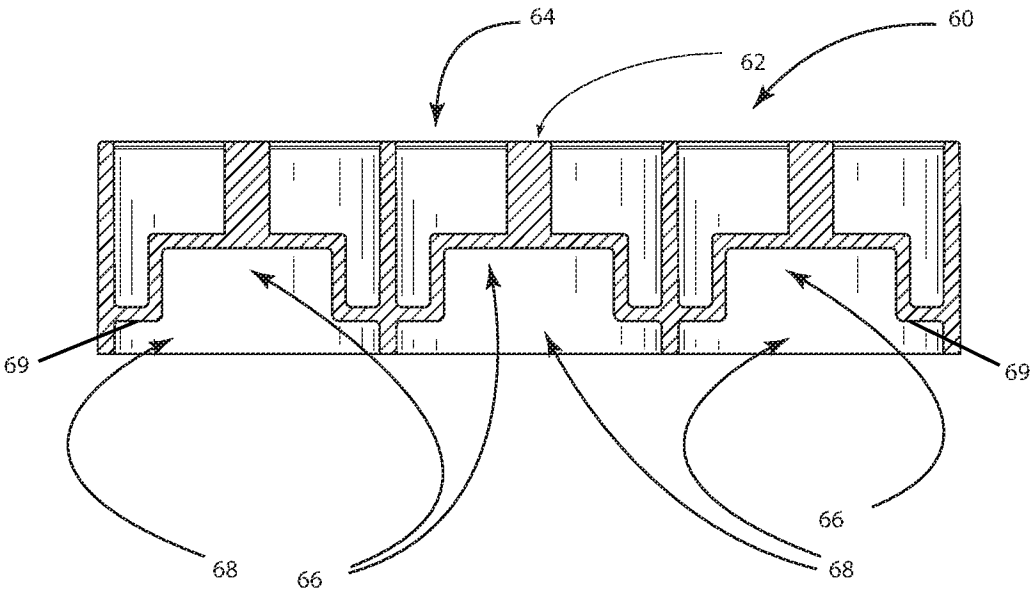
FIG. 10 is a sectional view of a spool organizer of FIG. 7 with the section being taken along Line 10-10 of FIG. 7.

FIGS. 7 through 10 illustrate spool organizer 60 suitable for use in the practice of the present invention having lower end receptacles 64 formed in upper surface 65 thereof while bobbin receptacles 66 and upper end receptacles 68 are formed in lower surface 67 thereof. Centrally located spool posts 62 extend into spool lower end receptacle 64 and are adapted to engage the central throughbores in spools of thread commonly sold at retail in the United States. Accordingly the maximum width thereof is preferably no more than 7.2 mm, more preferably no more than 7 mm and most preferably no more than 6.9 mm whilst the minimum width of spool lower end receptacle 64, as well as that of spool upper end receptacle 68, is at least about 19.5 mm, more preferably at least about 29 mm, still more preferably about at least about 35 mm, more preferably at least about 40 mm and most preferably at least about 42.5 mm. In FIG. 8, spool organizer 60 is illustrated with spools 90 retained therein, with bobbin toppers 20 having bobbins 80 mounted thereupon enabling the user to keep each supply spool associated with the bobbin having suitable thread 85 for it with free end 86 of thread on each bobbin 80 being retained in thread retention slit 46 in peripheral rim 24 of its associated bobbin topper 20. FIG. 9 illustrates two spool organizers 60, 61 having bobbins 80 and spools 90 stored therein, with spool organizer 61 being placed atop spool organizer 60 with upper ends of spools 90 resting in spool organizer 60 being nested within upper end receptacles 68 formed in lower surface 65 of spool organizer 61 and bobbins 80 lodged atop spools 90 in spool organizer 60 being received in bobbin receptacles 66 also formed in lower surface 65 of spool organizer 61. As shown in FIG. 10, the intersection between the larger-diameter upper end receptacle retention portion 68 and the smaller-diameter bobbin receptacle 66 forms a shoulder 69.

What is claimed is:

1. A multi-cavity spool holder having, on a first face, a multiplicity of lower end receptacles each adapted to receive a first end of a cylindrical supply spool ranging from about 19 mm up to about 42 mm in diameter, each lower end receptacle having an upright post positioned therein adapted to enter a central throughbore in the cylindrical supply spool having a diameter of from about 6.9 mm up to about 7.8 mm whilst a second face has a plurality of dual level upper end receptacles formed therein, each upper end receptacle having an upper wall comprising a lowermost portion of one of the lower end receptacles, a shoulder being formed in each upper wall approximately 12 mm beneath an upper surface of the dual level upper end receptacle forming a bobbin receptacle adapted to receive a bobbin having an outside diameter of up to 26 mm and a height of from 8.6 up to about 12 mm and a retention portion adapted to receive a second end of the cylindrical supply spool having a diameter up to 42 mm when the bobbin is mounted upon the second end of the cylindrical supply spool using a bobbin topper interpenetrating a throughbore in the bobbin and the central throughbore in the cylindrical supply spool;

wherein the multi-cavity spool holder is comprised of a translucent polymer or a transparent polymer.

2. The multi-cavity spool holder of claim 1, wherein the multiplicity of lower end receptacles is adapted to receive the first end of the cylindrical supply spool ranging from about 19 mm up to about 38 mm in diameter, and the retention portion is adapted to receive the second end of the cylindrical supply spool having a diameter up to 38 mm.

3. The multi-cavity spool holder of claim 2 wherein the spool holder is comprised of a polymer chosen from the group consisting of transparent polystyrene polymer and translucent polypropylene polymer.

4. The multi-cavity spool holder of claim 1 wherein the spool holder is comprised of a polymer chosen from the group consisting of transparent polystyrene polymer and translucent polypropylene polymer.

* * * * *